US005308060A

United States Patent [19]

Nakamura et al.

[11] Patent Number: 5,308,060

[45] Date of Patent: May 3, 1994

[54] TENNIS BALL

[75] Inventors: Masao Nakamura; Ichiro Tominaga, both of Kobe, Japan

[73] Assignee: Sumitomo Rubber Industries, Ltd., Kobe, Japan

[21] Appl. No.: 892,325

[22] Filed: Jun. 2, 1992

[30] Foreign Application Priority Data

Jun. 5, 1991 [JP] Japan ..... 3-162016

[51] Int. Cl.[5] ..... A63B 39/00

[52] U.S. Cl. ..... 273/61 B; 273/61 R; 428/280; 428/288

[58] Field of Search ..... 273/61 R, 61 B–61 D; 428/280, 288, 85, 91

[56] References Cited

U.S. PATENT DOCUMENTS 3,684,284 8/1972 Tranfield ..... 273/61 B
4,151,029 4/1979 Jones-Hinton ..... 273/61 B
4,439,471 3/1984 Lacoste et al. ..... 273/61 B

FOREIGN PATENT DOCUMENTS 57-154411 9/1982 Japan .
666468 2/1952 United Kingdom .
714481 9/1954 United Kingdom .
1588380 4/1981 United Kingdom ..... 273/61 B

*Primary Examiner*—Vincent Millin
*Assistant Examiner*—Steven B. Wong
*Attorney, Agent, or Firm*—Armstrong, Westerman, Hattori, McLeland & Naughton

[57] ABSTRACT

A tennis ball having a felt covering which has superior abrasion resistance, felt appearance and resistance to fuzzing which may occur during the use of ball, the felt covering being made of a polyethylene terephthalate fiber including a polyethylene terephthalate (PET) polymer containing at least 90 mole % of recurring ethylene terephthalate units which satisfies the following parameters:

(a) a value of hot air shrinkability/intrinsic viscosity of polymer falling within the range of 5.0 to 7.5%,
(b) birefringence of $170\times10^{-3}$ to $185\times10^{-3}$,
(c) Orientation factor for crystallites fc=0.935 to 0.950, and
(d) amorphous molecular orientation parameter of 0.75 to 0.90.

3 Claims, No Drawings

TENNIS BALL

BACKGROUND OF THE INVENTION

The present invention relates to a tennis ball comprising a spherical rubber core and a felt covering affixed thereto, and more particularly to an improvement in the felt covering.

Ordinary tennis balls generally consist of a spherical hollow core having a rubber elasticity and a felt or textile covering affixed onto the core.

For the felt for covering the core, there has been used, for instance, a woven felt called melton which is prepared by satin-weaving a blended yarn of wool and a chemical fiber such as nylon fiber; gigging and milling the satin fabric to form a felt having fibers firmly intertwined to form a dense structure; and a felt prepared by needle punching a fabric.

In general, a woven felt is used for top-grade tennis balls make from the viewpoint of good appearance. The woven felt has been generally prepared from a blended yarn of wool and nylon fiber in a ratio of from 60:40 to 70:30 by weight. It is also proposed to use a polyester or rayon fiber instead of nylon fiber to be blended with wool (e.g. Japanese Patent Publication Kokai No. 60-29157 and Japanese Patent Publication No. 59-135079).

In general, the woven felt is prepared by satin-weaving blended yarns of wool and a chemical fiber such as nylon, polyester or rayon fiber with the use of cotton fiber as under thread, subjecting the satin fabric to raising to form large quantities of raised fibers, and subjecting it to a milling processing peculiar to wool in order to make a raised fiber structure dense by intertwinement of the fibers, thus finishing up the satin fabric into a thick felt of good appearance. Such an intertwinement of the fibers resulting from the milling processing is peculiar to wool, and chemical fibers have no such action.

The felt covering of tennis balls reduces in thickness from being played since the felt fibers are gradually worn away and cut by repeated collision with a tennis court, thus resulting in a worn state. Wool is poor in abrasion resistance. Since a felt covering made of only wool shows marked abrasion by collision with a tennis court, it has been reinforced by blending a chemical fiber, as mentioned above. Nylon 6 and nylon 66 which are superior in tensile strength and dyeability, have been generally used as the chemical fiber for this purpose.

The fineness of the chemical fibers such as nylon used for this purpose is usually 6 deniers. In case of further increasing the abrasion resistance, chemical fibers having a fineness as thick as 12 deniers are used, but the use of 12 denier fibers is not desirable in that, since they are firm, namely bristle-like, it is difficult to sufficiently press down the fibers by milling processing, thus resulting in a rough appearance.

When nylon is used in an amount of 50% by weight or more in order to raise the abrasion resistance, milling effect is decreased, thus the obtained tennis balls show rough appearance, and also the ball characteristics are decreased so as to hinder playing due to marked napping during playing.

The felt covering has a function of decreasing an impact to a player at the time of striking a ball by a racket, and a function of controlling the ball speed by air resistance. These functions are also impaired by wear of the felt. That is to say, the tennis ball in play contacts the surface of a court and rebounds after sliding a short distance. At that time a frictional force generates between the ball and the court, whereby the fibers of the felt surface are gradually worn and cut away to reduce the thickness of the covering. Since the speed of ball struck increases with the increase of wear, the worn ball is no longer used and is exchanged with a new ball for playing. A high wear resistance of the felt covering is desired from an economical point of view.

In recent years, all weather tennis courts easy in maintenance have been popularly used, in addition to conventionally spread clay courts and en-tout-cas courts which do not so wear the felt covering. Various materials such as asphalt-type, polyurethanes and synthetic rubbers are used as the surface materials of all weather tennis courts, and among them some surface materials remarkably wear the felt covering. A high wear resistance of the covering is desired also from this a point of view.

It is a primary object of the present invention to improve the wear resistance of the felt covering of tennis ball while maintaining the good the appearance of the covering which directly affects the appearance of the ball itself and without decreasing a resistance to napping of the covering which occurs at the time of playing.

A further object of the present invention is to provide a tennis ball with a felt covering having an improved wear resistance, a good appearance and a good napping resistance.

These and other objects of the present invention will become apparent from the description hereinafter.

SUMMARY OF THE INVENTION

It has been found that when polyester fibers having specified properties are used as the synthetic fibers to be blended with wool fibers and a felt is prepared in a usual manner therefrom, the raised fiber structure can be made dense by milling processing to result in good appearance, and the abrasion resistance can be further improved as compared with conventional felts, thus it is very suitable as the covering for tennis balls and the balls can be used with decreased abrasion without causing napping of the felt during the use.

In accordance with the present invention, there is provided a tennis ball having a core and a felt covering affixed thereto. The felt covering is made of a fiber of a polyethylene terephthalate polymer containing at least 90% by mole of recurring units of ethylene terephthalate. This fiber satisfies the following conditions:

(a) hot air shrinkability/intrinsic viscosity of the polymer $\Delta S_{150°C}/IV = 5.0$ to 7.5%.

(b) birefringence $\Delta n_D = 170 \times 10^{-3}$ to $185 \times 10^{-3}$, (c) orientation factor for crystallites $fc = 0.935$ to 0.950, and (d) amorphous molecular orientation parameter $F = 0.75$ to 0.90.

DETAILED DESCRIPTION

The hot air shrinkability and the intrinsic viscosity of the polyethylene terephthalate polymer in the parameter (a) cited above are obtained respectively as follows:

(1) Hot air shrinkability $\Delta S_{150°C}$.

A sample fiber wound on a reel, namely a hank, is allowed to stand for 24 hours in a conditioning room at 20° C. and 65% RH (relative humidity). A sample having a length of $l_0$ measured under a load corresponding to 0.1 g/d of the sample is allowed to stand under a strainless condition in an oven at 150° C. for 30 minutes, the sample is taken out of the oven and the length $l_1$ thereof is then measured under the same loading as above. The hot air shrinkability is calculated according to the following equation.

$$\Delta S_{150^\circ C.} = (l_0 - l_1)/l_0 \times 100\%$$

(2) Intrinsic viscosity IV

In 100 ml of o-chlorophenol is dissolved 8 g of a sample fiber, and the relative viscosity $\eta r$ of the resulting solution is measured at 25° C. by Ostwald's viscometer (vertical capillary viscometer). The intrinsic viscosity IV is calculated according to the following equation:

$$IV = 0.0242\eta r + 0.2634$$

$$\eta r = (t \times d)/(t_0 \times d_0)$$

wherein t and $t_0$ are falling times of the sample solution and o-chlorophenol, respectively, and d and $d_0$ are densities of the sample solution and o-chlorophenol at 25° C., respectively.

The parameters (b), (c) and (d) mentioned above are measured as follows:

(b) Birefringence $\Delta n_D$

Birefringence is obtained by Berek compensator method using a POH type polarizing microscope made by Nikon Corporation and D-line as a light source.

(c) Orientation factor for crystallites fc

With respect to an intensity distribution along equator line of Debye-Scherrer ring, a half peak width H° of the diffraction intensity of each of Debye-Scherrer rings for (010) and (100) planes is obtained. The factor fc for each of (010) and (100) planes is calculated according to the following equation and the average value thereof is defined as orientation factor for crystallites fc.

$$fc = (180^\circ - H^\circ)/180^\circ$$

(d) Amorphous molecular orientation parameter F

A sample is immersed in a 0.2% by weight aqueous solution of a fluorescence reagent (trade mark "Mikephor ETN") at 55° C. for 3 hours, thoroughly washed with water and air-dried. The thus treated sample is used for measurement. A relative intensity of polarized fluorescence at an excitation wavelength of 365 nm and a fluorescence wavelength of 420 nm is measured by a fluorospectrophotometer. The amorphous molecular orientation parameter F is calculated according to the following equation:

$$F = 1 - (B/A)$$

wherein A is the relative intensity of polarized fluorescence in the axial direction of the fiber, and B is the relative intensity of polarized fluorescence in the vertical direction to the axis of the fiber.

The above-mentioned particular polyethylene terephthalate fiber used in the present invention has a low birefringence $\Delta n_D$ and a small amorphous molecular orientation parameter F. This means that the orientation of amorphous molecules present between crystalline regions is low and the amorphous molecules is in a very relaxed orientation state and, therefore, the differentiation between the crystalline layer and the amorphous layer is definite. It is considered that the presence of the amorphous molecules in the relaxed orientation state absorbs and lightens an impact frictional force that tennis balls receive at the time of contacting a court, thus raising the abrasion resistance.

The polyethylene terephthalate polymer which constitutes the fiber is a polymer comprising at least 90% by mole of ethylene terephthalate recurring units. The polymer may contain less than 10% by mole of units of dicarboxylic acids other than terephthalic acid and/or less than 10% by mole of units of diol compounds other than ethylene glycol.

The polyethylene terephthalate fiber is used as a constituent fiber of the felt covering. The fiber is usually formed into woven felts with wool fiber, and optionally with other synthetic fibers in a known manner. Needle felts prepared by using polyethylene terephthalate fiber may of course be used as the covering for the tennis balls.

In case of preparing woven felts, it is necessary to use wool. The amount of the polyethylene terephthalate fiber is from 5 to 50% by weight, preferably 15 to 40% by weight. The amount of wool fiber is from 50 to 95% by weight, preferably 60 to 85% by weight. Nylon fiber may be used with these fibers in order to reduce the cost, and the woven felt may contain at most 45% by weight, preferably at most 25% by weight, of nylon fiber.

The polyethylene terephthalate fiber used in the present invention is required to satisfy the value of hot air shrinkability/intrinsic viscosity of polymer ($\Delta S_{150^\circ C.}$/IV) within the range of 5.0 to 7.5%. When the value is more than 7.5%, durability, particularly abrasion resistance, of the obtained felt decreases, and when the value is lower than 5.0%, a satisfactory intertwinement of fibers is not achieved by milling processing, so no good appearance is obtained.

The polyethylene terephthalate fiber is required to have a birefringence of $170 \times 10^{-3}$ to $185 \times 10^{-3}$, since when the birefringence of the fiber is outside this range, the durability, particularly abrasion resistance, of the felt decreases.

The polyethylene terephthalate fiber is also required to have an orientation factor for crystallites fc of 0.935 to 0.950. when the factor fc of the fiber is more than 0.950, the feeling to the touch of the obtained felt is hard, and the feeling of striking balls becomes bad. Also, when the factor fc is less than 0.935, the fiber strength decreases, thus resulting in decrease of durability.

Further, the polyethylene terephthalate fiber is required to have an amorphous molecular orientation parameter F of 0.75 to 0.90. When the parameter F is more than 0.90, the durability decreases since the degree of orientation in the amorphous region becomes too large. When the parameter F is less than 0.75, creeps generate partly in yarns in the raising processing, giving a poor appearance.

The polyethylene terephthalate fibers which satisfy the above conditions (a) to (d) are, for example, commercially available under the trade mark "Toray Tetoron" #1500-360-705M (product of Toray Industries, Inc.).

Felts prepared by using the above-mentioned particular polyethylene terephthalate fibers can be used as the covering for covering cores of both pressurized tennis balls and pressureless tennis balls. Known cores prepared from various core rubber compositions can be used in the present invention.

The tennis balls of the present invention are prepared in a usual manner by using the above-mentioned particular felt covering.

The present invention is more specifically described and explained by means of the following Examples, in which all % are by weight unless otherwise noted.

EXAMPLES 1 TO 4 AND COMPARATIVE EXAMPLES 1 TO 5

Woven felts containing the polyethylene terephthalate fiber (hereinafter referred to as "PET") shown in Table 1 in the proportion shown in Table 2 were prepared and punched out into cocoon shapes to provide covering materials. Two sheets of the cocoon-shaped felts were stuck onto the surface of a hollow spherical core having 0.9 kg/cm$^2$ higher internal pressure than atmospheric pressure in a usual manner to cover the surface of the core, thus providing a pressurized tennis ball.

In Table 1, PET-1 is a polyethylene terephthalate fiber according to the present invention which satisfies the above-mentioned conditions (a) to (d). PET-2 is a conventional polyethylene terephthalate fiber which does not satisfy the conditions (a) to (d).

TABLE 1

| | PET-1 | PET-2 |
|---|---|---|
| Fineness (denier) | 6 | 6 |
| Strength (g/d) | 8.06 | 9.28 |
| Intrinsic viscosity IV | 0.93 | 0.92 |
| $\Delta S_{150°C}/IV$ | 6.12 | 11.1 |
| Birefringence $\Delta n_D$ ($1 \times 10^{-3}$) | 177 | 192 |
| Orientation factor for crystallites fc | 0.944 | 0.935 |
| Amorphous molecular orientation parameter F | 0.880 | 0.958 |

Each of the obtained tennis balls was played on an asphalt court for 1 hour by two players, and the state of abrasion of the felt covering was estimated visually according to the following criteria.

The results are also shown in Table 2.

Abrasion Resistance of Felt Covering

◎: Very excellent
○: Excellent
□: Good
×: Bad

TABLE 2

| | Example | | | | Comparative Example | | | | |
|---|---|---|---|---|---|---|---|---|---|
| | 1 | 2 | 3 | 4 | 1 | 2 | 3 | 4 | 5 |
| Fiber constitution (%) | | | | | | | | | |
| Wool | 65 | 65 | 65 | 65 | 65 | 65 | 65 | 65 | 65 |
| Nylon 6 | 27 | 20 | 15 | 0 | 35 | 27 | 20 | 15 | 0 |
| PET-1 | 8 | 15 | 20 | 35 | 0 | 0 | 0 | 0 | 0 |
| PET-2 | 0 | 0 | 0 | 0 | 0 | 8 | 15 | 20 | 35 |
| Abrasion resistance | □ | ○ | ◎ | ◎ | X | X | X | X | X |

As apparent from Tables 1 and 2, tennis balls of Comparative Examples 2 to 5 wherein PET-2 (conventional fiber) having a large amorphous molecular orientation parameter F, namely a low degree of the relaxation of molecular orientation in amorphous region, was used as a constituent fiber of the felt covering, were poor in abrasion resistance of the covering, in spite of having a larger fiber strength than PET-1 according to the present invention, as well as the tennis ball of Comparative Example 1 having a felt covering consisting of wool and nylon 6 fiber.

In contrast, the tennis balls of Examples 1 to 4 according to the present invention all were superior in the abrasion resistance of the felt covering, through the superiority varied depending on the amount of PET-1 used.

Also, the tennis balls of Examples 1 to 4 had a good appearance of the covering, and the napping resulting from the use was a little.

With respect to the tennis balls of Examples 1 to 4, forward deformation, return deformation and rebound were measured according to the following method together with the weight of balls. The results are shown in Table 3.

Forward Deformation (mm)

A tennis ball was subsequently compressed about 2.54 cm in three directions at right angles to each other. This procedure was repeated 3 times. That is to say, the ball was compressed 9 times total. In 2 hours after the above preliminary compression, the deformation was measured by a Stevens compression tester in the following manner.

The ball was compressed with an initial load of 3.5 pounds (1.575 kg) and the deformation was measured, and the ball was then compressed with a load of 18 pounds (8.165 kg) and the deformation was measured. The forward deformation is expressed by the difference (mm) between the deformation by a load of 3.5 pounds and the deformation by a load of 18 pounds.

Return Deformation (mm)

After measuring the deformation in the above forward deformation test, the ball was further compressed up to a deformation of 2.54 cm. Then the compression was reduced to a load of 18 pounds (8.165 kg), and the deformation was measured.

Rebound (cm)

A tennis ball was dropped from a height of 100 inches (254 cm) onto a concrete base, and the rebound of the ball (height from the concrete base to the bottom of the ball) was measured. The measurement was repeated 3 times and the average was obtained.

TABLE 3

| | Ex. 1 | Ex. 2 | Ex. 3 | Ex. 4 | Regulation of International Tennis Federation |
|---|---|---|---|---|---|
| Weight (g) | 57.2 | 57.4 | 57.1 | 57.2 | 56.7 to 58.5 |
| Forward deformation (mm) | 6.2 | 6.3 | 6.7 | 6.1 | 5.6 to 7.4 |
| Return deformation (mm) | 9.2 | 9.1 | 9.2 | 9.2 | 8.9 to 10.8 |
| Rebound (cm) | 142 | 141 | 143 | 142 | 135 to 147 |

As apparent from the results shown in Tablet 3, the tennis balls of Examples 1 to 4 according to the present invention all come up to the regulation of International Tennis Federation, and there is no problem in physical properties of balls.

From the results shown in Tables 2 and 3, it would be understood that the abrasion, resistance of covering of tennis balls can be improved, while maintaining the good appearance of the covering and with restraining occurrence of fuzzing during playing, by using a specific polyethylene terephthalate fiber as a constituent fiber of a felt covering for cores of tennis balls.

In addition to the ingredients used in the Examples, other ingredients can be used in the Examples as set forth in the specification to obtain substantially the same results.

What is claim is:

1. A tennis ball comprising a core and a woven felt covering affixed thereto, wherein said felt covering consists essentially of 5 to 50% by weight of a fiber of a polyethylene terephthalate polymer containing at least 90% by mole of recurring units of ethylene terephthalate, 50 to 95% by weight of a wool fiber and 0 to 45% by weight of a nylon fiber, said fiber of polyethylene terephthalate polymer satisfying the following conditions:

(a) hot air shrinkability/intrinsic viscosity of the polymer $\Delta S_{150°C}/IV = 5.0$ to 7.5%, (b) birefringence $\Delta n_D = 170 \times 10^{-3}$ to $185 \times 10^{-3}$, (c) Orientation factor for crystallites fc=0.935 to 0.950, and (d) amorphous molecular orientation parameter F=0.75 to 0.90.

2. A Tennis ball comprising a core and a woven felt covering affixed thereto, wherein said felt covering consists essentially of 5 to 50% by weight of a fiber of a polyethylene terephthalate polymer containing at least 90% by mole of recurring units of ethylene terephthalate, and 50 to 95% by weight of wool fiber, said fiber of polyethylene terephthalate polymer satisfying the following conditions:

(a) hot air shrinkability/intrinsic viscosity of the polymer $\Delta S_{150°C}/IV = 5.0$ to 7.5%, (b) birefringence $\Delta n_D = 170 \times 10^{-3}$ to $185 \times 10^{-3}$, (c) Orientation factor for crystallites fc=0.935 to 0.950, and (d) amorphous molecular orientation parameter F=0.75 to 0.90.

3. A Tennis ball comprising a core and a woven felt covering affixed thereto, wherein said felt covering consists essentially of 15 to 40% by weight of a fiber of a polyethylene terephthalate polymer containing at least 90% by mole of recurring units of ethylene terephthalate, 60 to 85% by weight of a wool fiber and 0 to 25% by weight of a nylon fiber, said fiber of polyethylene terephthalate polymer satisfying the following conditions:

(a) hot air shrinkability/intrinsic viscosity of the polymer $\Delta S_{150°C}/IV = 5.0$ to 7.5%, (b) birefringence $\Delta n_D = 170 \times 10^{-3}$ to $185 \times 10^{-3}$, (c) Orientation factor for crystallites fc=0.935 to 0.950, and (d) amorphous molecular orientation parameter F=0.75 to 0.90.

* * * * *